United States Patent [19]

Gryson

[11] Patent Number: 4,967,801

[45] Date of Patent: Nov. 6, 1990

[54] APPARATUS FOR SEPARATING A BROKEN WARP THREAD AT THE LOOM WARP STOP MOTION FROM THE WARP SHEET

[75] Inventor: Dirk Gryson, Dikkebus-Ieper, Belgium

[73] Assignee: Picanol N.V., Ieper, Belgium

[21] Appl. No.: 439,871

[22] Filed: Nov. 21, 1989

Related U.S. Application Data

[62] Division of Ser. No. 167,906, Mar. 4, 1988, Pat. No. 4,905,737.

[30] Foreign Application Priority Data

Mar. 13, 1987 [BE] Belgium ..... 8700254

[51] Int. Cl.[5] ..... D03J 1/14; D03D 51/20

[52] U.S. Cl. ..... 139/35; 139/351

[58] Field of Search ..... 139/35, 353, 358, 351, 139/36; 66/163; 28/207, 187, 205, 206, 208

[56] References Cited

U.S. PATENT DOCUMENTS

| | | | |
|---|---|---|---|
| 4,300,599 | 11/1981 | Wueger | 139/352 |
| 4,321,736 | 3/1982 | Rohner | 28/210 |
| 4,503,889 | 3/1985 | van Mullekom | 139/1 R |
| 4,573,856 | 3/1986 | Meyer et al. | 414/561 |
| 4,791,967 | 12/1988 | Vandeweghe et al. | 139/353 |
| 4,815,498 | 3/1989 | Gryson et al. | 139/351 |
| 4,817,675 | 4/1989 | Dewaele et al. | 139/35 |

FOREIGN PATENT DOCUMENTS

| | | | |
|---|---|---|---|
| 1467135 | 1/1967 | France . | |
| 60-9952 | 1/1985 | Japan . | |
| 68526 | 3/1951 | Netherlands . | |
| 2109426 | 6/1983 | United Kingdom | 139/35 |

*Primary Examiner*—Andrew M. Falik
*Attorney, Agent, or Firm*—Bacon & Thomas

[57] ABSTRACT

A device for removing a broken warp thread from a warp stop motion includes a plurality of extraction elements that may include nozzles, hooks, grippers and the like that lift a slack loop of broken warp thread at a fallen drop wire associated with the broken warp thread and move the loop to a position outside the stop motion by passing the loop sequentially from one nozzle, etc. to the next in a single direction until the loop is outside the stop motion, where it can be gripped by a thread holder for further manipulation.

11 Claims, 8 Drawing Sheets

Fig. 14
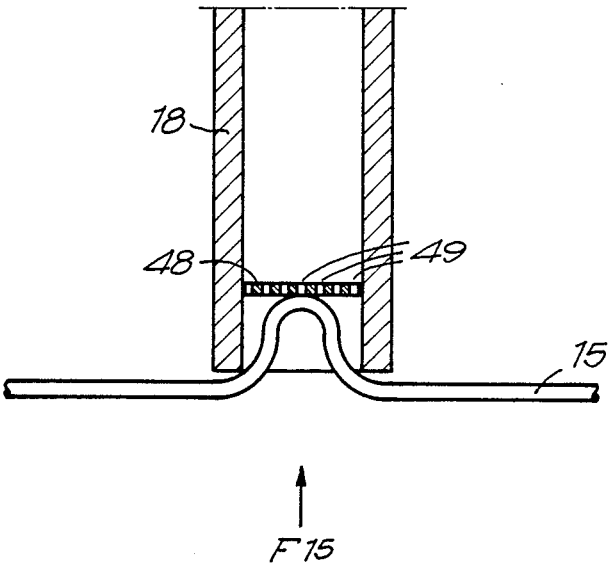
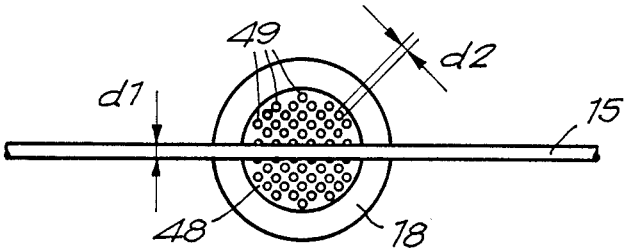
Fig. 15

APPARATUS FOR SEPARATING A BROKEN WARP THREAD AT THE LOOM WARP STOP MOTION FROM THE WARP SHEET

This application is a division, of application serial No. 07/167,906,. filed Mar. 14, 1988 now U.S. Pat. No . 4,905,737.

BACKGROUND OF THE INVENTION

This invention concerns a device for separating a broken warp thread at the warp stop motion from the warp sheet on a weaving machine—in particular on weaving machines of the type in which the warp stop motion consists of one or more rows of drop wires —in order to enable the broken warp thread to be automatically located and taken up.

A warp stop motion commonly used on weaving machines consists of a row of drop wires resting on the warp threads, so that when a warp thread break occurs, the corresponding drop wire makes an electrical contact or mechanical interlock, thus causing the machine to be stopped.

Dutch patent application No. 8600372—which corresponds to the U.S. Pat. No. 4,791,967 to Vandeweghe, et al., issued on Dec. 20, 1988 —describes a method of automatically locating the fallen drop wire, which is then gripped and raised in order to make it visibly stand out from the row of drop wires, thus enabling the weaver to see at a glance where a thread break needs to be repaired. Dutch patent application No. 8601819 which corresponds to U.S. Pat. No. 4,815,498 to Gryson et al issued Mar. 28, 1989, also describes a method for turning the fallen drop wire through an angle so that the neighboring drop wires are forced apart, thus forming a local opening in the unbroken warp threads, and so facilitating rethreading of the drop wire which is presented in this way.

Although the abovementioned patent documents are aimed at automating the process of warp thread repair, they do not offer any solution to the problem of dealing with the broken warp thread, which is usually still threaded through the fallen drop wire, either by removing it and replacing it with a new one or by tying it in again. The problem is mainly that the broken warp thread which remains threaded through the fallen drop wire first has to be located, which is fairly difficult to automate since the warp thread which was under tension contracts when it breaks and gets crossed over neighboring threads.

SUMMARY OF THE INVENTION

The present invention concerns a device for separating the broken warp thread at the warp stop motion from the warp sheet on a weaving machine, thus providing a solution to the problem described above. Further, the warp thread which is thus separated is also brought into the correct position with respect to the remaining warp threads, in other words not crossed over the neighboring threads.

To this end, the invention essentially involves a device for extracting the sagging loop—formed in the broken warp thread as a result of the drop wire falling—from the warp stop motion, back from the fallen drop wire: optionally, the fallen drop wire may first be raised before extracting the broken warp thread in this way.

In a preferred embodiment the loop is extracted from the warp stop motion back from the fallen drop wire by means of at least one airstream which exerts a force on the broken warp thread, starting at the point where the fallen (or raised) drop wire is located. Depending on the variant, the airstream may be provided by suction or blower nozzles.

In yet another embodiment, the force is exerted by mechanical means, for example grippers or hooks.

The device according to the present invention should preferably be used in combination with the system described in Dutch patent application No. 8601819 and the aforementioned U.S. Pat. No. 4,815,498, in which as well as being raised the fallen drop wire is also turned through an angle in order to facilitate the freeing of the broken warp thread. The effect of turning the drop wire in this way is to draw the neighboring warp threads away from the broken warp thread.

The present invention also concerns a device which essentially uses one or more suction nozzles, blower nozzles or mechanical means which operate in conjunction with the drop wire.

BRIEF DESCRIPTION OF THE DRAWINGS

For the purpose of describing the characteristics of the invention, the following preferred embodiments are described with reference to the accompanying drawings, by way of example only and without being limitative in any way, where:

FIG. 2 is a plan view (looking down on the warp sheet) and FIGS. 3 to 8 show the various stages of the method, in a cross section of the warp stop motion;

FIGS. 14 and 15 elevational and end views in partial cross-section show a particular embodiment of a suction nozzle or extraction tube (FIG. 15 being taken in the direction of arrow F15 in FIG. 14).

DESCRIPTION OF THE PREFERRED EMBODIMENT

Figure 1:
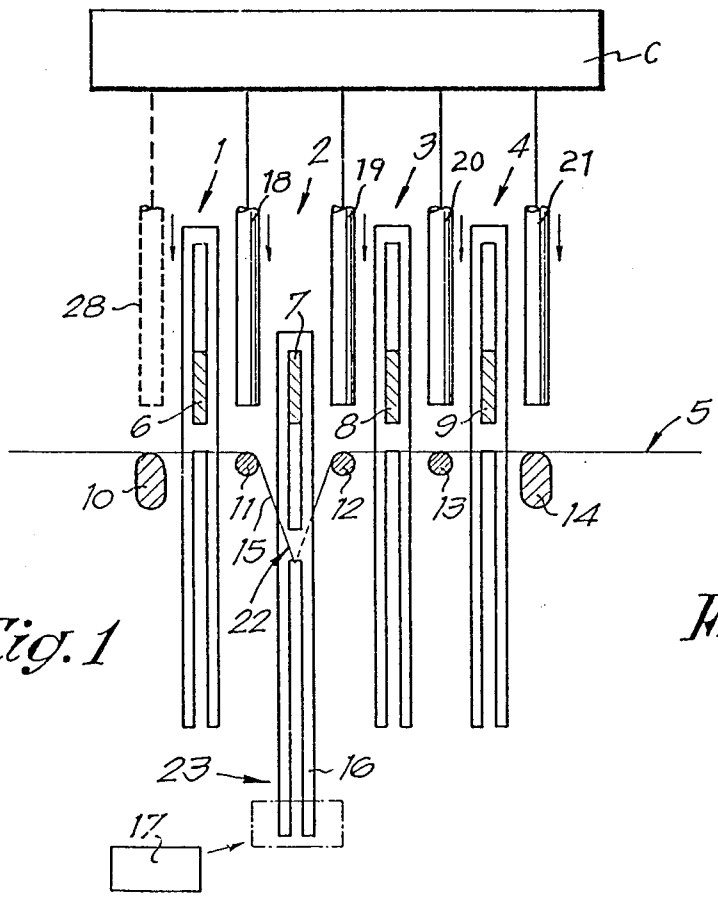
FIG. 1 represents a cross section of a warp stop motion, equipped with suction nozzles, at the point of the broken warp thread.

FIG. 1 shows a cross section of a warp stop motion consisting essentially of a number of rows of drop wires 1 to 4 which are suspended on the warp threads of the warp sheet 5, and which when they fall make an electrical contact with one the electrodes 6 to 9 respectively. The warp sheet 5 is led over supporting elements 10 to 14 on either side of the rows of drop wires 1 to 4.

In FIG. 1 a broken warp thread 15 is shown such that the corresponding drop wire 16 has fallen. Also in FIG. 1 there is a gripping device 17, more particularly as described in Dutch patent application No. 8601819, which manipulates the fallen drop wire 16.

The actual mechanism of the invention consists, in the embodiment illustrated, of a series of suction nozzles 18 to 21 which can move under control of an appropriate control system C which comprises a transport system as well as an activation and control device for the nozzles 18 through 21 in such a way that each suction nozzle 18 to 21 can be presented opposite one of a particular row of drop wires 1 to 4. The operation of the device according to the invention, using the method outlined above, is described below with the aid of the successive figures.

In FIG. 1 a warp thread break has occurred, in particular in warp thread 15. Here it should be noted that as a result of the drop wire 16 falling a sag 22 has been formed in the warp thread 15. The fallen drop wire 16 is located and gripped by the gripping device 17.

Figure 3:
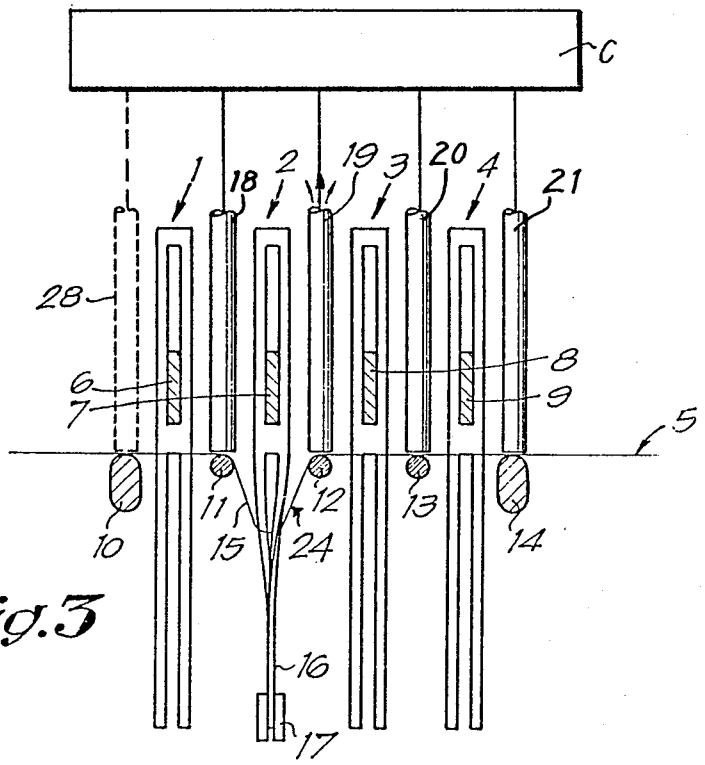
FIGS. 2 to 8 illustrate the operation of the device.
Figure 2:
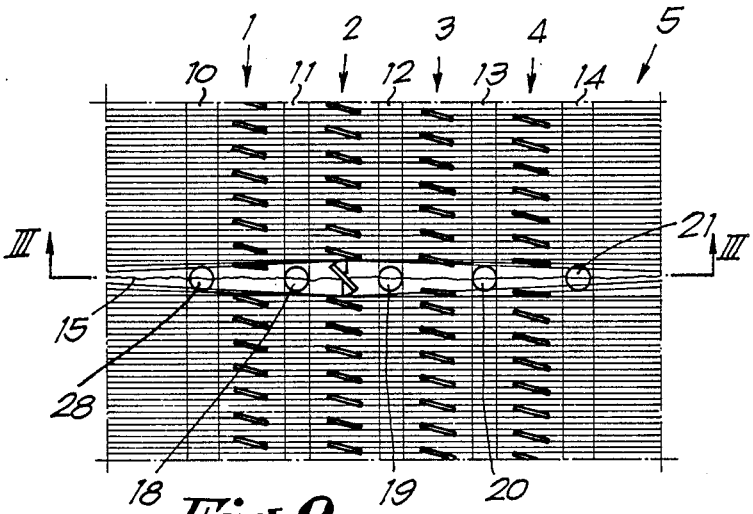

In the next step, the fallen drop wire 16 is gripped by its end 23, turned and raised by gripping device 17, as shown in FIG. 2. At the same time the suction nozzles 18 to 21 are lowered by control system C towards the warp sheet 5, almost right up to the supporting elements 11 to 14, as shown in FIG. 3.

Figure 4:
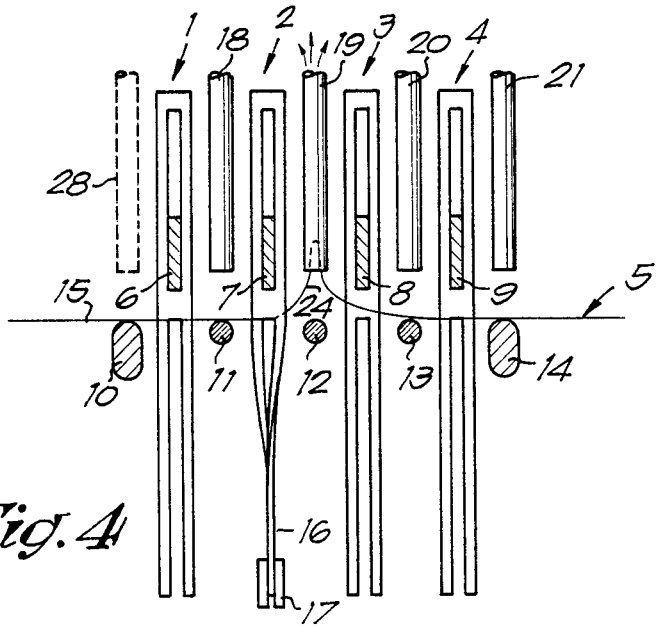

Obviously, the result of raising the fallen drop wire 16 will be that where previously there was a sag 22 in the warp thread 15 there will now be a free-hanging loop 24. At this stage, shown in FIG. 2, the suction nozzle 19 is activated by control system C, with the result that the warp thread 15 is drawn taut and perhaps also partly sucked in. As shown in FIG. 4, the suction nozzles 18 to 21 are now moved upwards by control system C, with the result that said loop 24 is displaced over a short distance, arriving over the supporting element 12, since the suction nozzle 19 drags the warp thread 15 towards it.

Control system C, of course, includes suitable control actuators or motors for the raising and lowering of the suction nozzles 18 to 21 sequentially or simultaneously and appropriate associated mechanisms known to those skilled in the art for connecting the actuators or motors to the nozzles. The actuators or motors in turn may be controlled via an appropriate central master control that governs operation of the motors, as well as the transport means 41 to be described below. The activation of the suction applied by each nozzle also may be controlled through the master control in a manner well known to those skilled in weaving machinery. The specific apparatus by which this control is achieved does not form a part of the present invention and may be implemented by any appropriate devices known to those skilled in weaving machinery technology.

Figure 5:
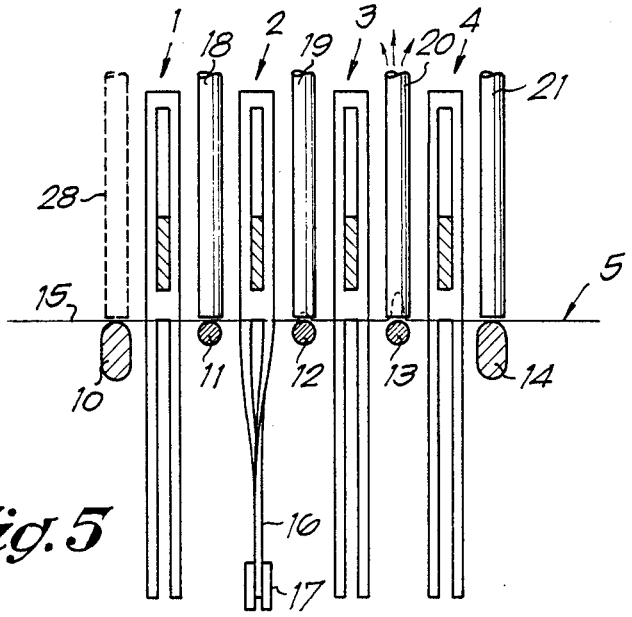
Figure 6:
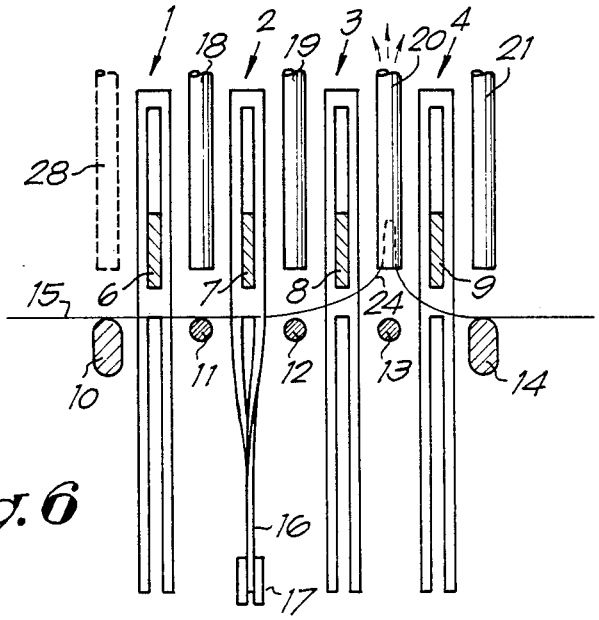

When the nozzles arrive in their highest position, suction nozzle 19 is deactivated and suction nozzle 20 is activated (the activation and deactivation times may overlap slightly). The series of suction nozzles is once more presented to the warp sheet 5, resulting in a situation as shown in FIG. 5. The warp thread 15 is then moved along by the action of suction nozzle 20, so that the loop is farther displaced to nozzle 20, as shown in FIG. 6.

Figure 7:
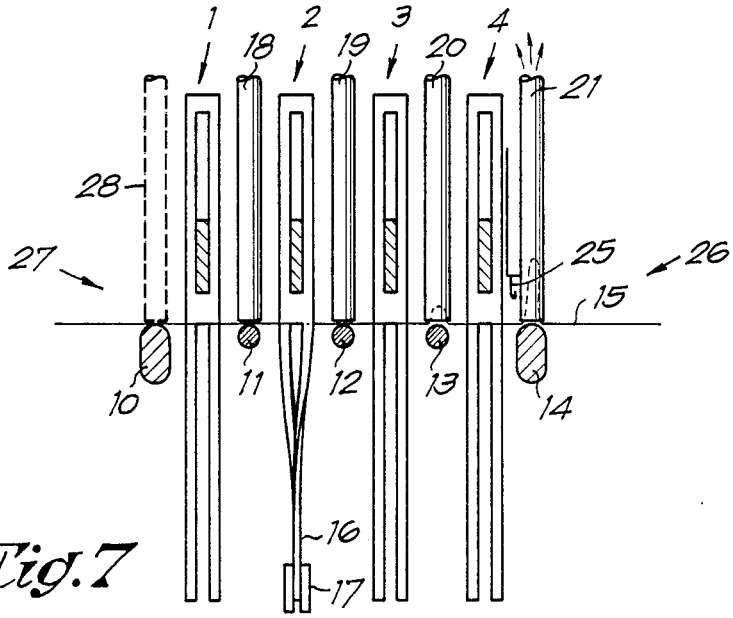
Figure 8:
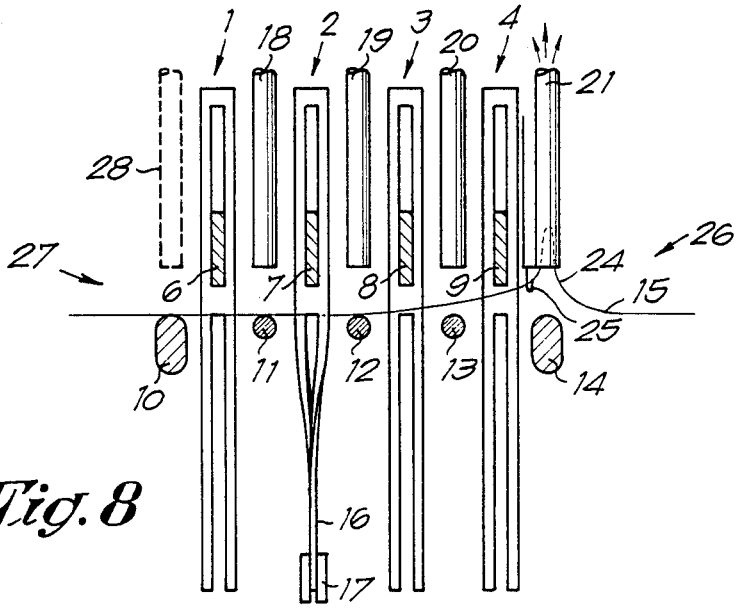

As shown in FIGS. 7 and 8, the above sequence is then be repeated for the last suction nozzle 21 so that the loop 24 is drawn out of the warp stop motion, away from the fallen drop wire 16. A hooking or gripping mechanism 25 may be positioned in proximity to the last suction nozzle 21 in order to take over the warp thread 15 from the suction nozzle 21, so that the latter may be deactivated. Said hooking or gripping mechanism 25 may then be used for further manipulation of the warp thread 15: however such manipulation is outside the scope of this invention. On commencement of the operation according to the method of the invention, it may be advantageous to first activate the nozzle 18 beside the fallen drop wire 16 opposite to the direction in which the loop 24 will be transported, in order to raise the warp thread 15 and so facilitate the transfer of said loop 24 between the other suction nozzles 19 to 21.

Clearly, other variations of the system described also possible. In one important variant, there is only one suction nozzle, which is first lowered beside the fallen drop wire 16, then activated and raised so as to draw the loop 24 with it, and subsequently deactivated and positioned over the following row of drop wires. This sequence is repeated until the suction nozzle arrives outside the warp stop motion, at which point the above-mentioned hooking or gripping mechanism 25 can take over the thread.

It also clear that in addition to the suction nozzles, the device must include the necessary transport, activation, deactivation and control functions necessary for the cycle to be carried out automatically.

The loop 24 can of course be carried either to side 26 or side 27 of the warp stop motion; in the latter case, there must be another suction nozzle 28 at the other side 27 of the warp stop motion.

In a variant, the operating cycle of the suction nozzles 18 to 21 is as follows. When a warp break is detected, all the suction nozzles 18 to 21 are lowered by control system C. The suction nozzle nearest the fallen drop wire 16 is activated and raised so that the broken warp thread 15 is raised with it; in the accompanying figures, the suction nozzle concerned would be nozzle 19. When the suction nozzle 19 arrives in its raised position, it is deactivated and the next suction nozzle 20, which is still in the lowered position, is activated and then raised. This process is repeated in a similar way until the loop 24 has been carried out of the warp stop motion.

In yet another operating cycle which may be used in the method according to the invention, only the suction nozzle 19 is lowered towards the fallen drop wire 16 and then raised, taking the broken warp thread 15 with it when it is raised.

The other suction nozzles are then activated and deactivated successively, so that the loop 24 is passed from one to the other until it arrives outside the warp stop motion, either on side 26 or on side 27, in other words going directly from the stage shown in FIG. 4 to the stage shown in FIG. 6, without moving the suction nozzles up and down.

In order to prevent the warp thread 15 remaining stuck inside a suction nozzle after it has been deactivated, due to the stiffness of the thread, thus preventing the loop 24 from being passed from one nozzle to another, positive pressure can be applied to the first nozzle when one nozzle is deactivated and the next activated, thus making sure that the loop 24 is released. A warp thread which gets stuck in a nozzle can also be freed by some mechanical device, e.g. rings or tubes 29 mounted concentrically on the suction nozzles 18 to 21 and which move up and down.

The suction nozzles 18 to 21, and also nozzle 28 if provided, can also be mounted underneath the warp sheet 5 instead of above it.

Figure 10:
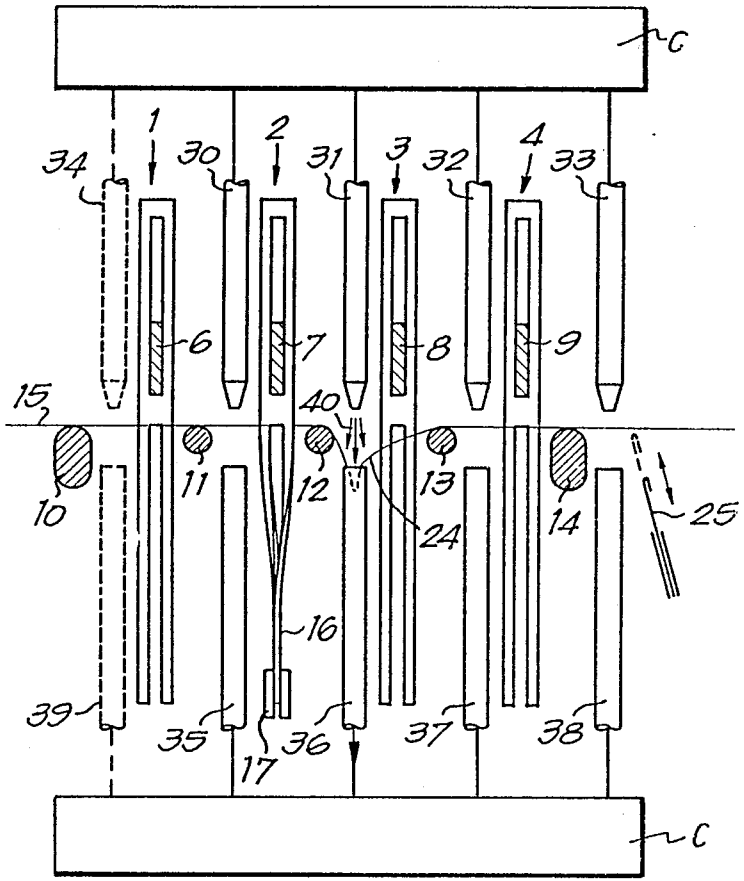
FIG. 10 shows schematically and in an elevational, partial cross-section view a device which uses blower nozzles mounted above the warp sheet.
Figure 9:
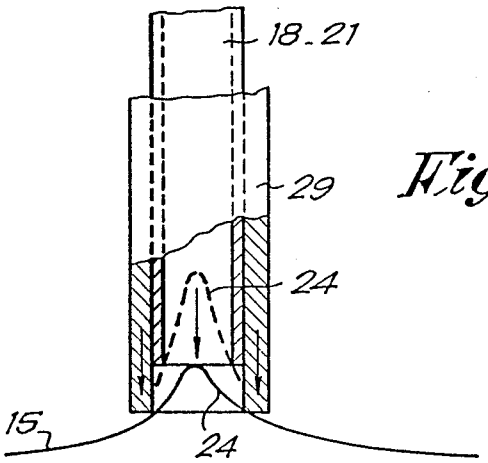
FIG. 9 shows an elevation view in partial cross-section of a particular embodiment of a suction nozzle, such as may be used in the device according to the invention.

In the variant shown in FIG. 10, the method of the invention is accomplished by using a succession of air-jets at various points to displace the loop 24 in the broken warp thread 15, starting at the fallen drop wire 16 and progressing to one of the sides of the warp stop motion, in this case side 26. To this end the suction nozzles 18 to 21, and nozzle 28 if provided, are replaced by blower nozzles 30 to 34. No up and down motion is necessary if such blower nozzles are used. The operation of the device may be simply deduced from FIG. 10, and is more or less analagous to the method using suction nozzles.

It is possible to provide extraction tubes 35 to 39 mounted opposite the blower nozzles 30 to 34, in order to promote evacuation of the airstream from whichever blower nozzles are activated. The extraction tubes may also operate as suction nozzles, so that there is a combined action of blower and suction nozzles. The extraction tubes can be activated by the control system C as well.

Figure 11:
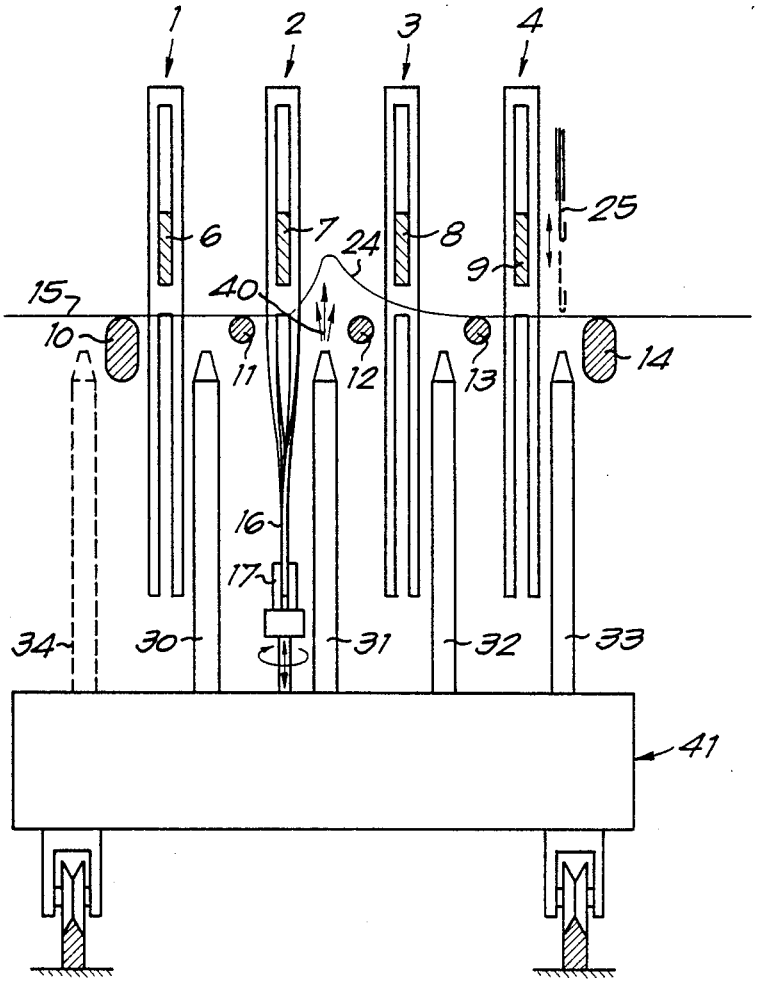
FIG. 11 schematically shows a variant of the embodiment in FIG. 10, in which the blower nozzles are mounted under the warp sheet.

In the variant shown in FIG. 11, the blower nozzles 30 to 33, and also blower nozzle 34 if provided, are mounted underneath the warp sheet 5. This has the advantage that they can be mounted on the same transport mechanism 41 as the rotatable gripper device 17.

Figure 13:
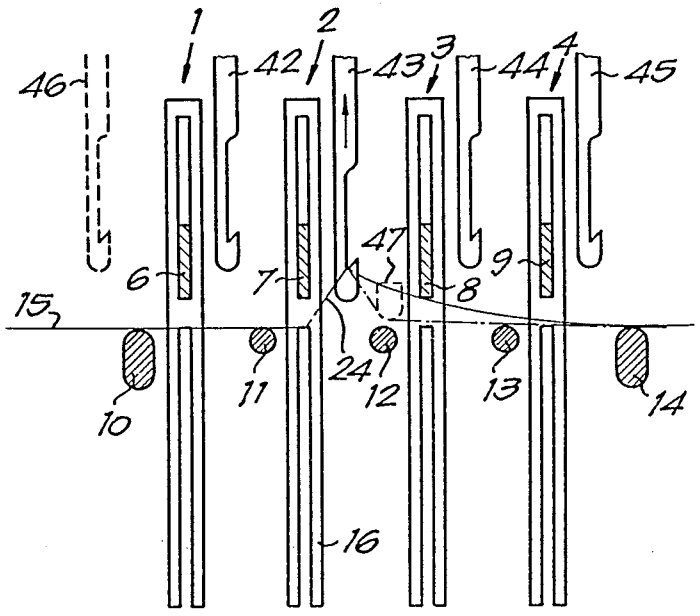
FIGS. 12 and 13 show yet another variant which uses a hook to move the sagging loop.
Figure 12:
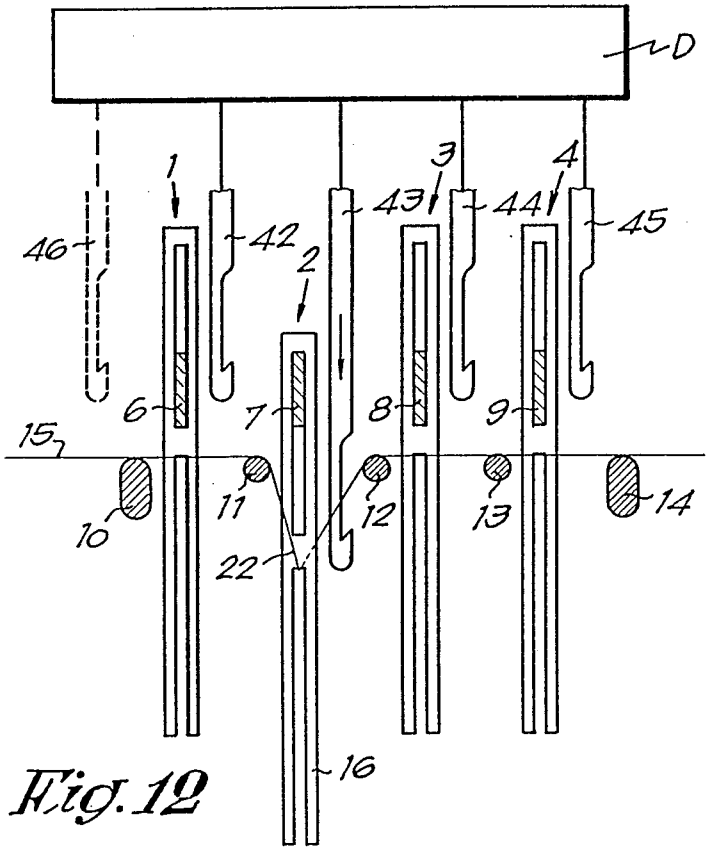

As shown in FIGS. 12 and 13, the loop 24 can also be transported out of the warp stop motion by means of hooking or gripping devices controlled by control system D. In the variant illustrated, the suction nozzles are replaced by hooks 42 to 45, and also hook 46 if provided, which move up and down when activated by control system D, thus raising the loop 24, starting at the fallen drop wire 16. The particularity of this method is that, as shown in the two figures, it is not necessary for the fallen drop wire 16 to be presented and raised by a special gripping device 17, since the corresponding drop wire will be raised by the action of gripper 43 in FIG. 13.

The motion of the hooks must of course be controlled in such a way that they operate separately one after the other so that they carry the loop 24 in the warp thread 15 with them. In order to avoid unwanted effects on the loop 24, it is also possible for a guide 47 for the broken warp thread to be lowered. Clearly, suitably controlled gripping or clamping devices may be used instead of the hooks 42 to 45. The hooking, gripping or clamping devices may of course also be mounted under the warp sheet 5.

In a preferred embodiment as shown in FIG. 14 the suction nozzles 18 to 21 or the suction nozzle 28 may be provided with a sieve-shaped element 48 which prevents the broken warp thread 15 being sucked completely into the suction nozzles 18 to 21 or 28. In the same way the extraction tubes 35 to 39 may also be provided with a sieve-shaped element 48 which prevents the broken warp thread 15 being blown completely into the extraction tubes 35 to 39.

As shown in FIG. 15 the sieve-shaped element 48 may be provided with holes 49 whereby the diameter of the holes 49 is less than the diameter of the warp thread 15 in order to prevent the warp thread being sucked into the holes 49.

The present invention is in no way limited to the variants described by way of example and shown in the accompanying figures: on the contrary, such a method and device for extracting a broken warp thread from the warp sheet in weaving machines may be made in all sorts of variants while still remaining within the scope of the invention.

I claim:

1. A device for removing a broken warp thread from a warp sheet at a warp stop motion, said warp stop motion including a plurality of warp threads forming said warp sheet extending in a first direction and a plurality of drop wires arrayed in rows, the rows extending in a second direction transverse to said first direction, said drop wires being arranged such that when one of said warp threads breaks, one of said drop wires falls, causing said broken warp thread to sag and form a loop, said device comprising:

a series of suction nozzles arranged in a row extending in said first direction;

means for moving said series of suction nozzles towards a row of drop wires which includes a fallen drop wire to a position whereat one of said suction nozzles in said series of suction nozzles is located adjacent said fallen drop wire but displaced from said fallen wire in said first direction and also in a third direction transverse to a plane which includes said first and second directions, and whereat said series of suction nozzles are disposed generally parallel to said warp sheet along said first direction and spaced therefrom by a predetermined distance;

activating means arranged to successively activate said suction nozzles along said first direction so that said one suction nozzle, when activated, initially draws the slack of said loop of broken warp thread towards the suction nozzle by moving the slack in said first and third directions, and the succeeding nozzles, when activated, successively repeat such slack movement in like manner;

said series of suction nozzles extending at least from said one suction nozzle location to a location outside the drop wire rows.

2. A device as claimed in claim 1, wherein the warp sheet extends generally horizontally, the suction nozzles are mounted above the warp sheet and said third direction is vertically upwards.

3. A device as claimed in claim 1 or 2 wherein at least one of said suction nozzles includes a thread movement limiting means for limiting the degree to which the warp thread slack may be ingested while the nozzle is activated.

4. A device as claimed in claim 3 wherein said thread movement limiting means comprises an apertured wall extending across the suction nozzle within its opening and at a distance from its entrance, the diameter of the apertures in said wall being smaller than the warp thread-diameter.

5. A device for removing a broken warp thread from a warp sheet at a warp stop motion, said warp motion including a plurality of warp threads forming said warp sheet extending in a first direction and a plurality of drop wires arrayed in rows, the rows extending in a second direction transverse to said first direction, said drop wires being arranged such that when one of said warp threads breaks, one of said drop wires falls, causing said broken warp thread to sag, the slack in said thread forming a loop, said device comprising:

a series of blower nozzles arranged in a row extending in said first direction;

means for moving said series of blower nozzles towards a row of drop wires which includes a fallen drop wire to a position whereat one of said blower nozzles in said series of blower nozzles is located adjacent said fallen drop wire but displaced from said fallen drop wire in said first direction and also in a third direction transverse to a plane which includes said first and second directions, and whereat said series of blower nozzles are disposed generally parallel to said warp sheet along said first direction and spaced therefrom by a predetermined distance;

means for successively activating said blower nozzles along said first direction so that said one blower nozzle, when activated, initially directs the slack of said loop of broken warp thread towards the blower nozzle by moving the slack in said first direction and in a direction opposite to said third direction, and the succeeding nozzles, when activated, successively repeat such slack movement in like manner;

said series of blower nozzles extending at least from said one blower nozzle location to a location outside the drop wire rows.

6. A device as claimed in claim 5, wherein the warp sheet extends generally horizontally; the blower nozzles are mounted underneath the warp sheet; and said third direction is vertically downward.

7. A device as claimed in claim 5, including a transport mechanism movable in a direction parallel to the rows of drop wires, and a clamping means mounted on the transport mechanism for gripping an end of the fallen drop wire and raising it and turning it through an angle to release it from the broken warp thread.

8. A device as claimed in claim 1 or 5 including a hooking and gripping means disposed outside the drop wire rows on one side of the warp stop motion for hooking and gripping the broken warp thread after the slack has been moved by the suction or blower nozzles from within the warp stop motion to said location outside the drop wire rows.

9. A device as claimed in claim 5 further including an extraction suction tube located opposite the warp sheet and opposite each blower nozzle, each extraction tube including means, when activated, for catching the slack of the warp thread loop when it is moved by said blower nozzle, said extraction tubes including thread movement limiting means for limiting the degree to which the warp thread slack may be ingested while the extraction tube is activated.

10. A device as claimed in claim 9 wherein said thread movement limiting means comprises an apertured wall extending across the extraction tube within its opening and at a distance from its entrance, the diameter of the apertures in said wall being smaller than the warp thread diameter.

11. A device for removing a broken warp thread from a warp sheet at a warp stop motion, said warp stop motion including a plurality of warp threads forming said warp sheet extending in a first direction and a plurality of drop wires arrayed in rows, the rows extending in a second direction transverse to said first direction, said drop wires being arranged such that when one of said warp threads breaks, one of said drop wires falls, causing said broken warp thread to sag, the slack in said thread forming a loop, said device comprising:

a series of movable hooks arranged in a row extending in said first direction;

means for moving said series of movable hooks towards a row of drop wires which includes a fallen drop wire to a position whereat one of said hooks in said series of hooks is located adjacent said fallen drop wire but displaced from said fallen drop wire in said first direction and also in a third direction transverse to a plane which includes said first and second directions, and whereat said series of movable hooks are disposed generally parallel to said warp sheet along said first direction and spaced therefrom by a predetermined distance;

means for successively activating said movable hooks along said first direction so that said one hook, when activated, initially directs the slack of said loop of broken warp thread towards the hook by moving the slack in said first and third directions, and the succeeding hooks, when activated, successively repeat such slack movement in like manner;

said series of hooks extending at least from said one hook location to a location outside the drop wire rows.

* * * * *